US006227881B1

(12) United States Patent
Tharp et al.

(10) Patent No.: US 6,227,881 B1
(45) Date of Patent: May 8, 2001

(54) CABLE MANAGEMENT COUPLING AND SHIELDING INTERCONNECT SYSTEM AND METHOD

(75) Inventors: Keith Franklin Tharp, San Jose; Timothy Mark Scarano, Hayward, both of CA (US)

(73) Assignee: The JPM Company, Lewisburg, PA (US)

( * ) Notice: Subject to any disclaimer, the term of this patent is extended or adjusted under 35 U.S.C. 154(b) by 0 days.

(21) Appl. No.: 09/538,618

(22) Filed: Mar. 29, 2000

Related U.S. Application Data

(60) Provisional application No. 60/169,095, filed on Dec. 6, 1999.

(51) Int. Cl.[7] ..... H01R 4/66; H01R 13/648

(52) U.S. Cl. ..... 439/98; 174/29; 174/36; 174/73.1

(58) Field of Search ..... 439/98, 610, 579; 174/29, 36, 34, 73.1, 74 R, 78, 99 R, 70 S

(56) References Cited

U.S. PATENT DOCUMENTS

| | | | |
|---|---|---|---|
| 3,990,765 | 11/1976 | Hill | 339/177 |
| 4,109,222 | 8/1978 | Frano et al. | 335/301 |
| 4,272,148 | 6/1981 | Knack, Jr. | 439/455 |
| 4,382,653 | 5/1983 | Blanchard | 439/610 |
| 4,615,578 | 10/1986 | Stadler et al. | 339/143 |
| 4,808,128 | 2/1989 | Werth | 439/610 |
| 5,217,392 | 6/1993 | Hosler, Sr. | 439/585 |
| 5,246,376 | 9/1993 | Schuhl et al. | 439/98 |
| 5,338,896 | 8/1994 | Danforth | 174/35 R |
| 5,342,203 | 8/1994 | Perretta et al. | 439/76.1 |
| 5,368,504 | 11/1994 | Muzslay et al. | 439/610 |
| 5,447,453 | 9/1995 | Smith et al. | 439/701 |
| 5,474,473 | 12/1995 | Perretta et al. | 439/610 |
| 5,558,535 | 9/1996 | Saka et al. | 439/357 |
| 5,746,625 | 5/1998 | Aparicio et al. | 439/610 |
| 5,815,618 | 9/1998 | Takahashi et al. | 385/60 |
| 5,952,613 * | 9/1999 | Miettinen | 174/74 R |

* cited by examiner

*Primary Examiner*—Brian Sircus
*Assistant Examiner*—Javaid Nasri
(74) *Attorney, Agent, or Firm*—Duane, Morris & Heckscher LLP

(57) ABSTRACT

A cable shielding interconnect is provided that includes a star-anvil having a base and a plurality of radially projecting arms that are circumferentially spaced from one another so as to define a plurality of cable support saddles between the arms. At least two shielded cables, each including a dielectric jacket and at least one shielding member, are positioned within respective ones of the saddles, with each shielding member being electrically and mechanically accessible. A ferrule is positioned in crimped coaxial relation to the star-anvil and the at least two shielded cables are positioned in corresponding ones of the saddles so as to position each of the electrically and mechanically accessible shielding members in electrical communication with the star-anvil. The invention also provides for selective electrical interconnection of shields. A method is also provided for interconnecting cable shielding to a common electrical potential.

21 Claims, 4 Drawing Sheets

CABLE MANAGEMENT COUPLING AND SHIELDING INTERCONNECT SYSTEM AND METHOD

This Application claims priority from Provisional Patent Application Ser. No. 60/169,095, filed on Dec. 6, 1999, and titled STARSHIELD.

FIELD OF THE INVENTION

The present invention generally relates to the management and termination of shielded cables, and more particularly to the termination of multiple shields to a at least one electrical potential.

BACKGROUND OF THE INVENTION

It is well known for cables that transmit digital electrical signals to be provided with a electromagnetic shield. Typically, this shield is in the form of a metal braid, metal or conductive plastic foil and drain wire, metal screen, or the like, which is arranged so as to isolate and protect the signal conductors within the cable from electromagnetic interference or to prevent the inducement of electromagnetic interference in neighboring equipment. A separate shield may be provided for each individual signal conductor, or a conductive shield may be provided around a bundle of signal conductors. A combination of one or more shields may be employed for added protection against electromagnetic interference and/or to improve the signal transmission properties of the cable. To terminate bundles of shielded cables, it is necessary not only to connect each of the individual wires, but also to ground each of the shields. Sometimes the shields are commonly interconnected, while other times groups of shields must be placed at differing electrical potentials. In addition, it is often necessary to mechanically bundle one or more whole cables together so as to provide for strain relief for the bundle.

A number of techniques are known in the art for terminating one or more shielded cables. For example, in U.S. Pat. No. 5,246,376, issued to Schuhl, et. al., an adaptor for an electrical connector is disclosed which enables the shields of a number of shielded electrical wires to be terminated, and which also provides electromagnetic shielding for the wires. Schuhl's connector includes an electrically conductive outer body having a central aperture through which a plurality of wires are positioned, an electrically conductive shielding member that can be positioned within the aperture, and a plurality of electrically conductive hollow deformable ferrules. One of the ferrules is coaxially positioned over each of the wires so as to be in electrical engagement with the wire's shield. The shielding member is a sprocket-shaped annular ring having a central through-bore and a plurality of recesses located around its periphery. The ferrules are sized and shaped to be held in a corresponding one of the recesses of the shielding member when the ferrules are deformed during assembly of Schuhl's connector. A split, tapered ring holds the ferrules securely in the recesses of the shielding member so that a locking ring may be tightened to hold the assembly together. Schuhl's ferrules are apparently capable of being removed from their respective recesses so that the connector may be disassembled for repair.

SUMMARY OF THE INVENTION

In its broadest aspects, the present invention provides a cable management and strain relief coupling comprising a base having a plurality of radially projecting arms arranged in circumferentially spaced relation to one another so as to define a plurality of saddles that provide support for at least one cable, and a ferrule positioned in crimped coaxial relation to the base and the at least one cable. The base and ferrule are often formed of electrically conductive materials. In this way, the cable management and strain relief coupling of the present invention may be used to mechanically secure together numerous cables with varying electrical interconnections being formed between the cables. For example, at least two cables may be mechanically secured together with a shielding member that is associated with each of the cables being electrically interconnected to a common electrical potential. Alternatively, at least two cables may be mechanically secured together with a shielding member that is associated with at least one of the cables being electrically interconnected to another shielding member, or to another electrical potential, or both.

In one embodiment, at least two bases and at least two ferrules are provided in spaced apart relation to one another along a bundle of separate cables, and arranged so as to (i) mechanically secure together a plurality of cables, and (ii) electrically interconnect at least one shielding member of at least one of the plurality of cables to another shielding member of at least one of the plurality of cables, or to another electrical potential, or both.

In another embodiment, a cable management and strain relief coupling includes a star-anvil having a conductive base and a plurality of radially projecting arms that are circumferentially spaced from one another so as to define a plurality of cable support saddles between the arms. At least two shielded cables, each including a dielectric jacket and at least one shielding member, are positioned within respective ones of the saddles wherein each shielding member is electrically and mechanically accessible. A ferrule is positioned in coaxial relation to the star-anvil and the at least two shielded cables are positioned in corresponding ones of the saddles so as to position each of the electrically and mechanically accessible shielding members in electrical communication with the star-anvil. The ferule is then crimped to hold the cable shield interconnect together.

A method for interconnecting cable shielding to at least one electrical potential is also provided in which the a shielding member on each of at least two cables is exposed so as to be electrically accessible, and then positioned so that the exposed shielding members are arranged in electrical and mechanical engagement with an outer surface of a star-anvil. The cables and the star-anvil member are then positioned within a unitary open ended cylindrical ferrule and crimped.

BRIEF DESCRIPTION OF THE DRAWINGS

These and other features and advantages of the present invention will be more fully disclosed in, or rendered obvious by, the following detailed description of the preferred embodiment of the invention, which is to be considered together with the accompanying drawings wherein like numbers refer to like parts and further wherein.

DETAILED DESCRIPTION OF THE PREFERRED EMBODIMENT

Figure 1:
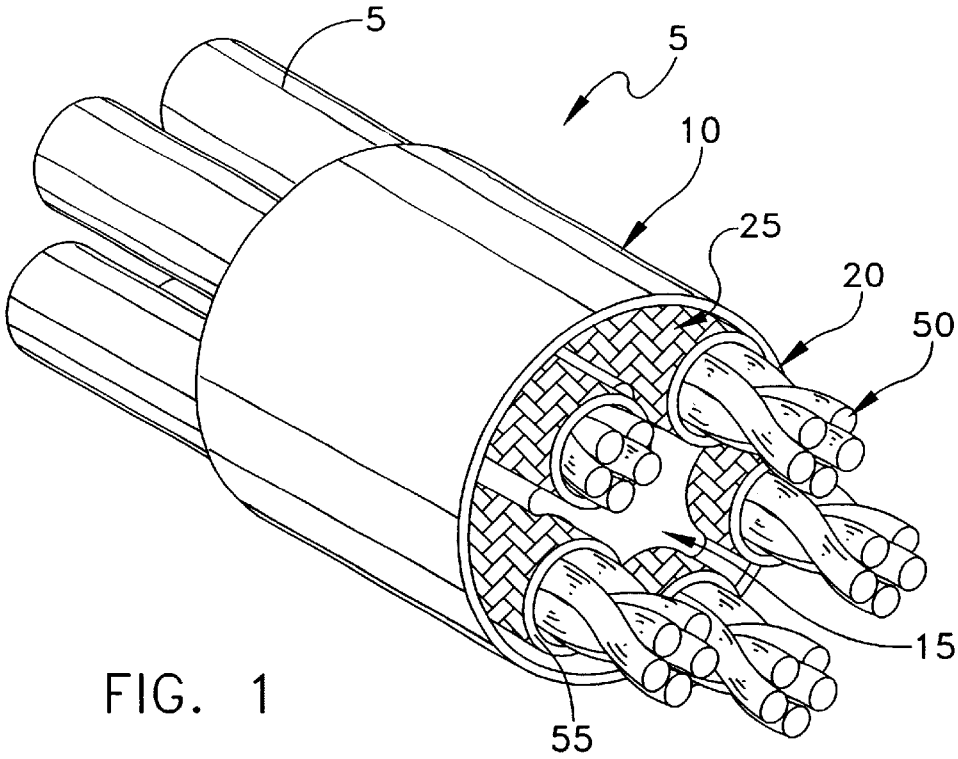
FIG. 1 is a perspective view of a cable shielding interconnect system formed in accordance with the present invention.

This description of preferred embodiments is intended to be read in connection with the accompanying drawings, which are to be considered part of the entire written description of this invention. In the description, relative terms such as "horizonal," "vertical," "up," "down," "top" and "bottom" as well as derivatives thereof (e.g., "horizontally," "downwardly," "upwardly," etc.) should be construed to refer to the orientation as then described or as shown in the drawing figure under discussion. These relative terms are for convenience of description and normally are not intended to require a particular orientation. Terms including "inwardly" versus "outwardly," "longitudinal" versus "lateral" and the like are to be interpreted relative to one another or relative to an axis of elongation, or an axis or center of rotation, as appropriate. Terms concerning attachments, coupling and the like, such as "connected" and "interconnected," refer to a relationship wherein structures are secured or attached to one another either directly or indirectly through intervening structures, as well as both movable or rigid attachments or relationships, unless expressly described otherwise. The term "operatively connected" is such an attachment, coupling or connection that allows the pertinent structures to operate as intended by virtue of that relationship.

Referring to FIGS. 1–4, cable management and shielding interconnect system 5 comprises a single ferrule 10 and a base or star-anvil 15 that are arranged so as to (i) mechanically secure together at least two cables 20, along a portion of their length, and (ii) electrically interconnect a shielding 25, that is associated with each cable, to one another, to a common electrical potential, or to electrical potentials of differing value. More particularly, ferrule 10 comprises a unitary open ended cylinder formed from a relatively ductile, conductive metal, such as brass, copper, phosphor bronze, or mild steels of the types that are well known in the cable and connector arts. The outer and inner surfaces of ferrule 10 are often coated with a highly conductive metal, such as tin, silver, or the like. Ferrule comprises a diameter that is sized so as to easily slip over the cables to be interconnected.

Figure 2:
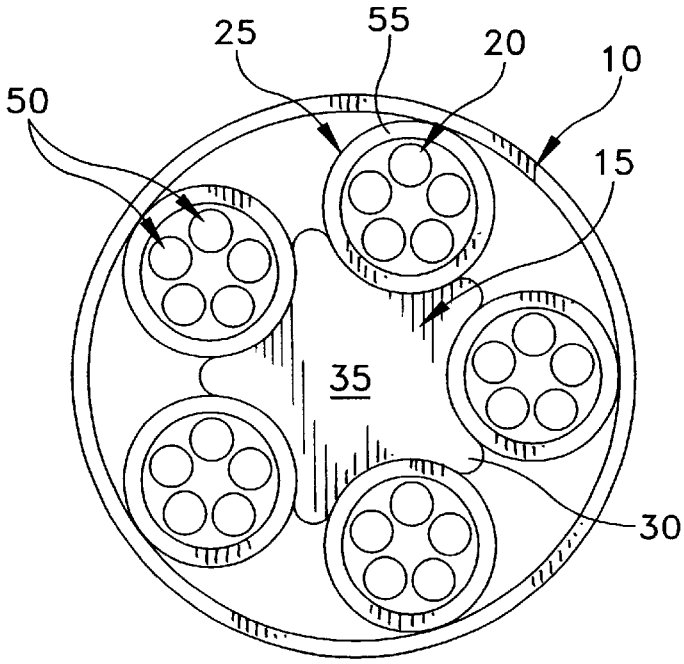
FIG. 2 is a front elevational view of the cable shielding interconnect system shown in FIG. 1.
Figure 3:
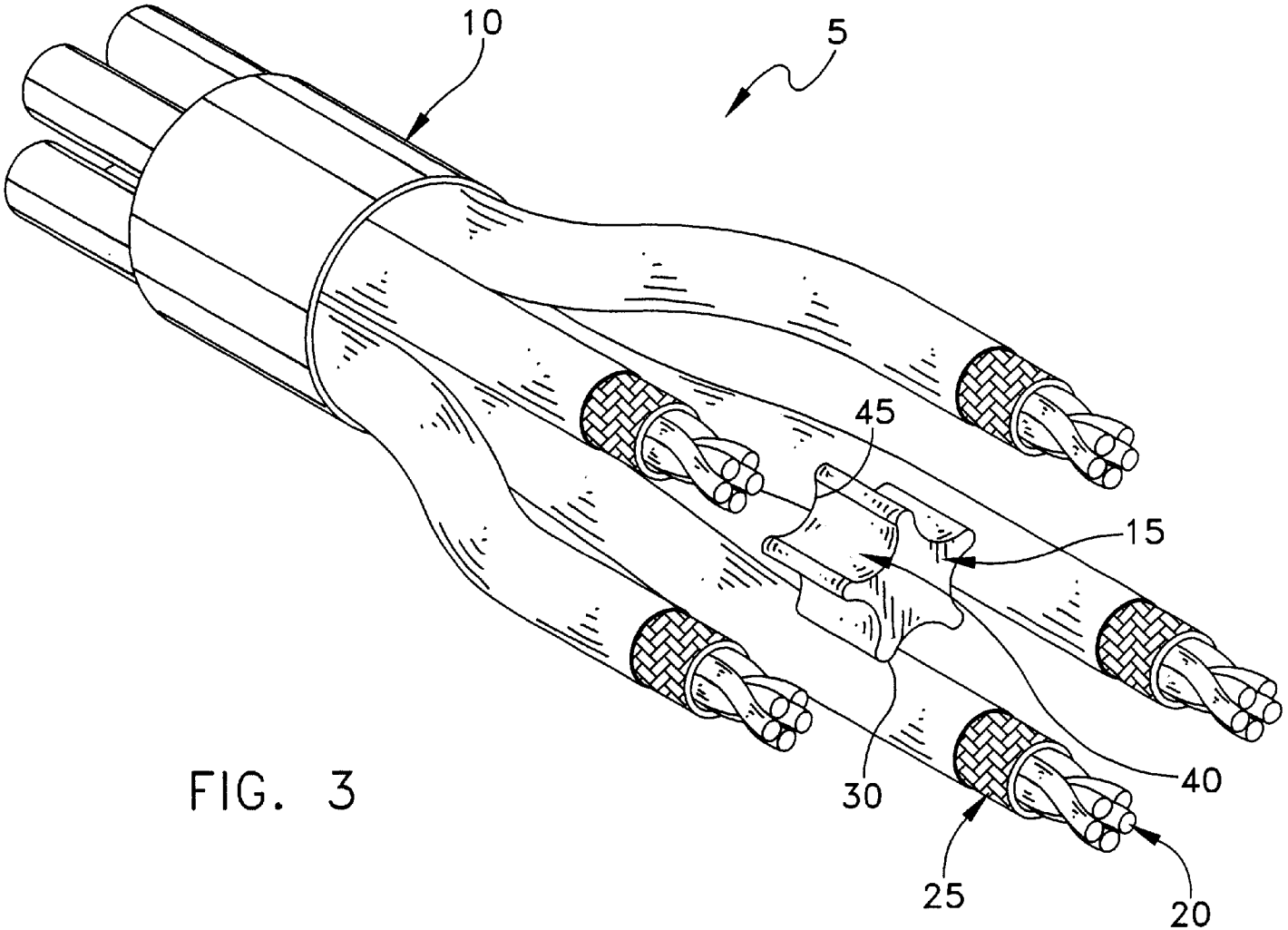
FIG. 3 is an exploded perspective view of the cable shielding interconnect system shown in FIG. 1.
Figure 4:
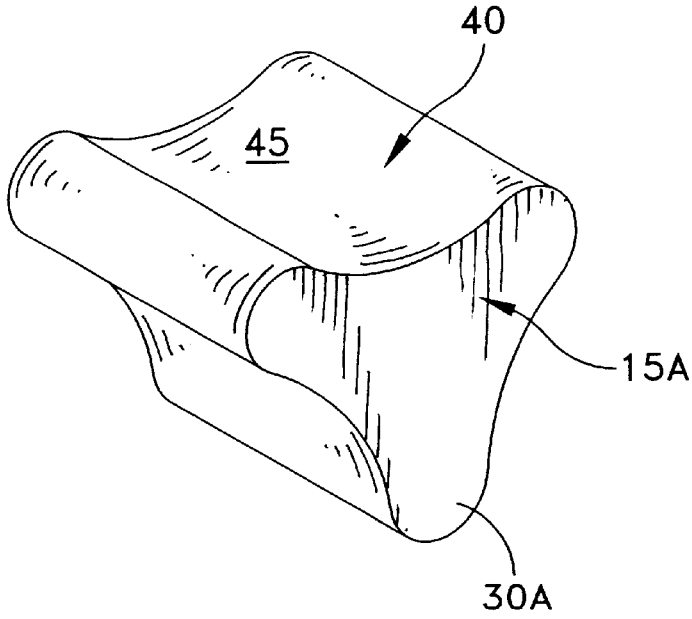
FIG. 4 is a perspective view of one exemplary embodiment of a star-anvil formed according to the present invention having three radial arms.
Figure 5:
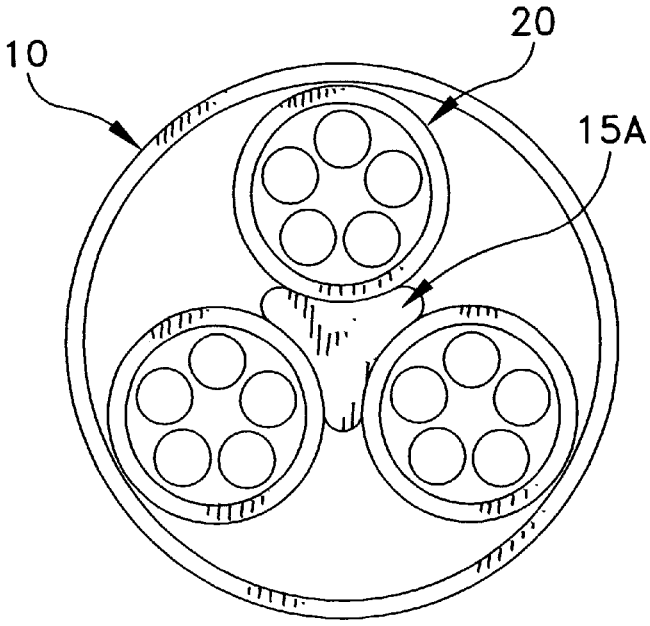
FIG. 5 is a front elevational view of the cable shielding interconnect system shown in FIG. 4.
Figure 6:
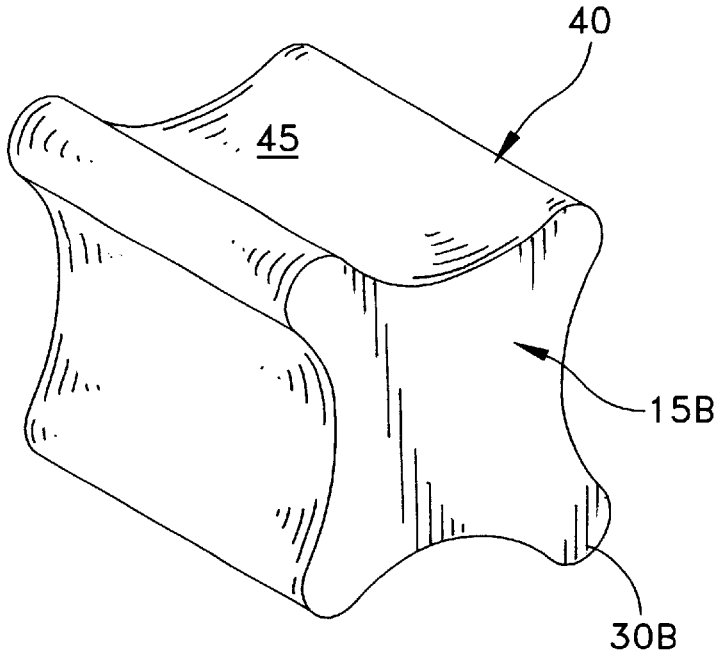
FIG. 6 is a perspective view of another exemplary embodiment of a star-anvil formed according to the present invention having four radial arms.
Figure 7:
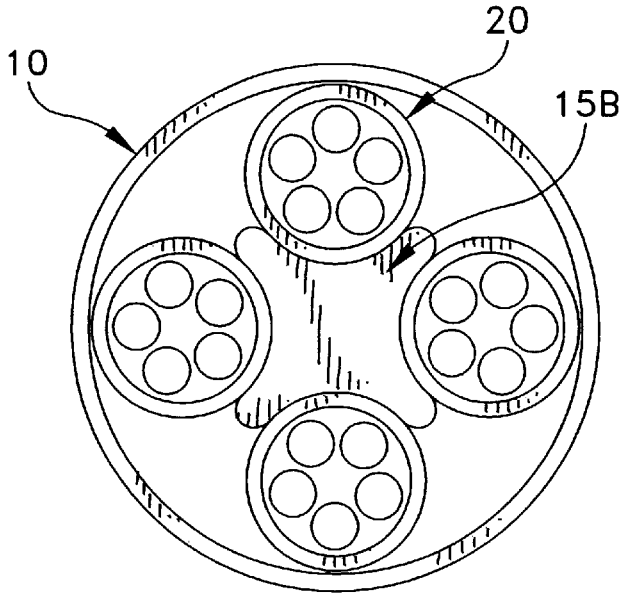
FIG. 7 is a front elevational view of the cable shielding interconnect system shown in FIG. 6.

Star-anvil 15 is often circularly symmetric, electrically conductive, and includes at least two arms 30 that project radially outwardly from a common base 35. Base 35, together with arms 30, define a plurality of spaced, circumferentially arranged saddles 40, each having a central seat 45. Saddles 40 often comprise a parabolic shape so that arms 30 taper to a narrow tip or blunt point. Saddles 40 and seats 45 do not necessarily have the same size or shape, and will often vary in size and shape when cables of differing diameter or numbers of conductors and shields are interconnected. Both arms 30 and saddles 40 are coextensive with base 35. Star-anvil 15 may include any number of arms. As shown in FIGS. 1–3, star-anvil may include five or more arms 30 defining five or more saddles 40. Alternatively, a star-anvil 15*a* may comprise three radially projecting arms 30*a* (FIGS. 4 and 5) and a star-anvil 15*b* may comprise four radially projecting arms 30*b* (FIGS. 6 and 7). Star-anvil 15*b* is particularly useful for coupling two cables together according to the method of the present invention.

Star-anvil 15 is often between about 10 mm to about 30 mm in length and about 10 mm to about 50 mm in diameter, as measured at the tips of arms 30. Star-anvil 15 is preferably formed from a conductive material, such as brass, copper, phosphor bronze, or mild steels. Alternatively, star-anvil 15 may be formed from an extruded or injection molded polymer that has been modified to be electrically conductive. The outer and inner surfaces of star-anvil 15 may also be coated with a highly conductive metal such a tin, silver, or the like material of the type that is well known for electrical interconnection.

Cable management and shielding interconnect system 5 is assembled and terminated to two or more shielded cables 20 of the type that are well known for electrical interconnection, and generally comprise at least one centrally located conductor 50, an internal dielectric jacket 55, at least one shielding member 25, and an outer dielectric jacket 60. It will be understood that any combination or number of conductors, shields, or dielectric jackets, or any number of cables comprising such structures, may be used in connection with the present invention. Such shielded cables 20 are most often used for high speed data, voice, and/or video communications.

In one embodiment of the invention, least two cables 20 are arranged such that their shielding members 25 (e.g., a surrounding metal braid, metal foil, or the like) are exposed. This is typically done by stripping outer dielectric jacket 60 away from a terminal portion of each cable 20. Once in this form, cables 20 are positioned in circumferentially spaced relation to one another with star-anvil 15 positioned between them (FIGS. 1 and 2). In this arrangement, each cable 20 is positioned in confronting relation to a central seat 45 of a saddle 40. Ferrule 10 is then slid over cables 20 and star-anvil 15 until ferrule 10 is in coaxial overlying relation with cables 20 and star-anvil 15.

In this position, shown in FIGS. 1, 2, 5 and 7, star-anvil 15 is fully within the interior of ferrule 20, with each cable 20 positioned within a corresponding saddle 40, and with each shielding member 25 exposed and adjacent to both a central seat 45 and a portion of the inner surface of ferrule 10. Once in this position, ferrule 10 is crimped using any of the well known ferrule crimping tools so that ferrule 20 is collapsed radially inwardly around cables 20, shield members 25, and star-anvil 15. In this way, both star-anvil 15 and ferrule 10 electrically and mechanically engage shielding members 25. As this occurs, shielding members 25 are pressed into intimate electrical and mechanical engagement with the conductive surfaces of central seat 45 and ferrule 10. As a consequence, ferrule 10, shielding members 25, and star-anvil 15 may be maintained at a common electrical potential.

Unlike the prior art, cable management and shielding interconnect system 5 requires no additional parts to create a satisfactory electrical and mechanical engagement between shielding members 25, star-anvil 15 and ferrule 10. Also, star-anvil 15 maintains each of cables 20 in circumferentially spaced-apart relation to one another during crimping, since arms 30 are interspersed between each cable 20. Common base 35 is solid and therefore acts to redistribute the inwardly directed crimping forces so that cables 20 do not "bunch-up" which could lead to less than adequate electrical interconnection.

The cable management and strain relief coupling system of the present invention may be used to mechanically secure together numerous cables with varying electrical interconnections being formed between the cables. For example, some of cables 20 may not have their outer dielectric jacket 60 stripped, so that no electrical interconnection can be made with a star-anvil 15. By way of example, and in no way to be interpreted to be limiting, three cables 20 may be mechanically secured together, with one or two shields 25 being electrically interconnected to one another (via electrical interconnection with star-anvil 15) while one cable is left mechanically secured to the other two, but not electrically interconnected. Thus in this arrangement two of three cables may be electrically interconnected, while one is not, yet all are mechanically secured together. Two or more star-anvils 15 and two or more ferrules 10 may be provided in spaced apart relation to one another along the length of a bundle of separate cables. The cables may then be selectively stripped to expose selective ones of their respective shields 25 adjacent to different ones of star-anvils 15. Cables 20 can then be mechanically secured together while their respective shields 25 are selectively electrically interconnected to one another or to differing electrical potentials, or both.

Advantages of the Invention

Numerous advantages are obtained by employing the present invention. More specifically, a cable management and shielding interconnect system is provided which avoids many of the aforementioned problems associated with prior art devices.

In addition, cable management and shielding interconnect system is provided which allows for effective 360 degree termination of common shielding materials.

Furthermore, a cable management and shielding interconnect system is provided that creates an effective strain relief for all of components of the cable assembly.

Also, a cable management and shielding interconnect system is provided that allows for the smallest achievable geometry electrical packaging solution, i.e., smallest achievable footprint for the completed cable assembly.

Furthermore, a cable management and shielding interconnect system is provided that allows for stackable or side-by-side arrangement of cable assemblies with out increasing the overall footprint.

Also, a cable management and shielding interconnect system is provided that reduces the creation of interstitial spaces that reduces the effectiveness of the shielding.

Furthermore, a cable management and strain relief coupling is provided that allows for selective electrical interconnection of selective ones of the respective shields of the cables.

It is to be understood that the present invention is by no means limited only to the particular constructions herein disclosed and shown in the drawings, but also comprises any modifications or equivalents within the scope of the claims.

What is claimed is:

1. A cable management and strain relief coupling comprising a base having a plurality of radially projecting arms arranged in circumferentially spaced relation to one another so as to define a plurality of saddles that provide support for at least one cable, and a ferrule positioned in crimped coaxial relation to said base and said at least one cable wherein said ferrule comprises a unitary open ended cylinder formed from a relatively ductile metal and having at least an inner surface coated with a highly conductive metal.

2. The cable management and strain relief coupling according to claim 1 wherein said base and said ferrule are electrically conductive and arranged so as to (i) mechanically secure together at least two cables, and (ii) electrically interconnect a shielding member that is associated with each of said cables to a common electrical potential.

3. The cable management and strain relief coupling according to claim 1 wherein said base and said ferrule are electrically conductive and arranged so as to (i) mechanically secure together at least two cables, and (ii) electrically interconnect a shielding member that is associated with at least one of said at least two cables to an electrical potential.

4. The cable management and strain relief coupling according to claim 1 wherein said base and said ferrule are electrically conductive and arranged so as to (i) mechanically secure together at least three cables, and (ii) electrically interconnect at least one shielding member that is associated with at least one of said at least three cables to an electrical potential.

5. The cable management and strain relief coupling according to claim 1 wherein said base and said ferrule are electrically conductive and arranged so as to (i) mechanically secure together a plurality of cables, and (ii) electrically interconnect at least one shielding member of at least one of said plurality of cables to another shielding member of at least one of said plurality of cables.

6. The cable management and strain relief coupling according to claim 1 wherein said base includes at least three arms.

7. The cable management and strain relief coupling according to claim 6 wherein said base together with said arms define a plurality of spaced, circumferentially arranged saddles each having a central seat.

8. The cable management and strain relief coupling according to claim 7 wherein said saddles comprise a parabolic shape so that said arms taper outwardly.

9. The cable management and strain relief coupling according to claim 1 wherein said base includes at least three arms defining at least three saddles.

10. The cable shielding interconnect according to claim 1 wherein said base includes four arms defining four saddles.

11. The cable shielding interconnect according to claim 1 wherein said base is formed from a molded conductive polymer.

12. The cable management and strain relief coupling comprising at least one base each having a plurality of radially projecting arms arranged in circumferentially spaced relation to one another so as to define a plurality of saddles that provide support for at least one cable, and at least one ferrule, one positioned in crimped coaxial relation to said at least one base and said cables, wherein said at least one base and said at least one ferrule are spaced apart and arranged so as to (i) mechanically secure together a plurality of cables, and (ii) electrically interconnect at least one shielding member of at least one of said plurality of cables to another shielding member of at least one of said plurality of cables wherein said at least one ferrule comprises a unitary open ended cylinder formed from a relatively ductile metal and having at least an inner surface coated with a highly conductive metal.

13. A cable shielding interconnect comprising;

a star-anvil having a symmetric conductive base and a plurality of radially projecting arms that are circumferentially spaced from one another so as to define a plurality of cable support saddles between said arms; and a unitary open ended cylindrical ferrule formed from a relatively ductile metal and having at least an inner surface coated with a highly conductive metal and positioned in crimped coaxial relation to said star-anvil.

14. The cable shielding interconnect according to claim 13 wherein said star-anvil and said ferrule are arranged so as to (i) mechanically secure together at least two cables, and (ii) electrically interconnect a shielding that is associated with each of said cables to a common electrical potential.

15. The cable shielding interconnect according to claim 13 wherein said star-anvil is circularly symmetric, electrically conductive, and includes at least three arms that project radially outwardly from a common base.

16. The cable shielding interconnect according to claim 13 wherein said saddles comprise a parabolic shape so that said arms taper and further wherein both said arms and said saddles are coextensive with said base.

17. The cable shielding interconnect according to claim 13 wherein said star-anvil includes five arms defining five saddles.

18. The cable shielding interconnect according to claim 13 wherein said star-anvil includes three arms defining three saddles.

19. The cable shielding interconnect according to claim 13 wherein said star-anvil includes four arms defining four saddles.

20. The cable shielding interconnect according to claim 13 wherein said star-anvil is formed from a molded conductive polymer.

21. A cable shielding interconnect system comprising;

at least two shielded cables each including a dielectric jacket and at least one shielding member wherein said shielding member is electrically and mechanically accessible;

a star-anvil having a symmetric base and a plurality of radially projecting arms that are circumferentially spaced from one another so as to define a plurality of cable support saddles between said arms; and a ferrule formed from a relatively ductile metal and having at least an inner surface coated with a highly conductive metal positioned in crimped coaxial relation to said star-anvil with said at least two shielded cables positioned in corresponding ones of said saddles so as to position each of said electrically and mechanically accessible shielding members in electrical communication with said star-anvil.

* * * * *